United States Patent [19]

Nordmeyer

[11] Patent Number: 4,479,674

[45] Date of Patent: Oct. 30, 1984

[54] DEVICE FOR CARRYING ELONGATED ITEMS

[75] Inventor: Robert Nordmeyer, Woodland Hills, Calif.

[73] Assignee: Ski Tote USA, Canoga Park, Calif.

[21] Appl. No.: 475,103

[22] Filed: Mar. 14, 1983

[51] Int. Cl.[3] ..... A63C 11/02

[52] U.S. Cl. ..... 294/147; 294/163; 294/165

[58] Field of Search ..... 294/141–143, 294/146, 147, 149, 151, 153, 154, 159, 161–165, 167, 169, 170; 211/60 SK; 224/917; 280/814, 815

[56] References Cited

U.S. PATENT DOCUMENTS

| | | | |
|---|---|---|---|
| 705,878 | 7/1902 | Shottenberg | 294/164 |
| 3,330,573 | 7/1967 | Sieloff | 280/815 |
| 3,718,242 | 2/1973 | Larson | 294/147 |
| 3,780,920 | 12/1973 | Green | 294/147 X |
| 3,935,977 | 2/1976 | Bonnett | 294/147 |
| 3,990,655 | 11/1976 | Covell | 294/147 |
| 4,040,551 | 8/1977 | Brumbaugh | 294/159 X |
| 4,190,182 | 2/1980 | Hickey | 294/159 X |
| 4,274,571 | 6/1981 | Lafreniere et al. | 294/147 |

FOREIGN PATENT DOCUMENTS

| | | | |
|---|---|---|---|
| 111331 | 7/1944 | Sweden | 211/60 SK |

*Primary Examiner*—Johnny D. Cherry

[57] ABSTRACT

A device for conveniently and securely carrying elongated items has a pair of hingeable members hingeably connected to each other at one of their ends. At least one of the pair of hingeable members comprises an inner plate and an outer plate. The inner plate can be releasably secured to the outer plate so that the inner and outer plates define a cavity which receives an elongated item. A handle is provided on at least one of the hingeable members at the end thereof opposite the hinge. A latch is provided on the two hingeable members and cooperates to releasably fasten the members together in a side-by-side relationship to define a closed position of the device. In this way, elongated items can be carried securely and conveniently. The device can be opened from a closed position to attain two configurations, namely, a fully open, horizontal position and a ski-insertion position.

27 Claims, 6 Drawing Figures

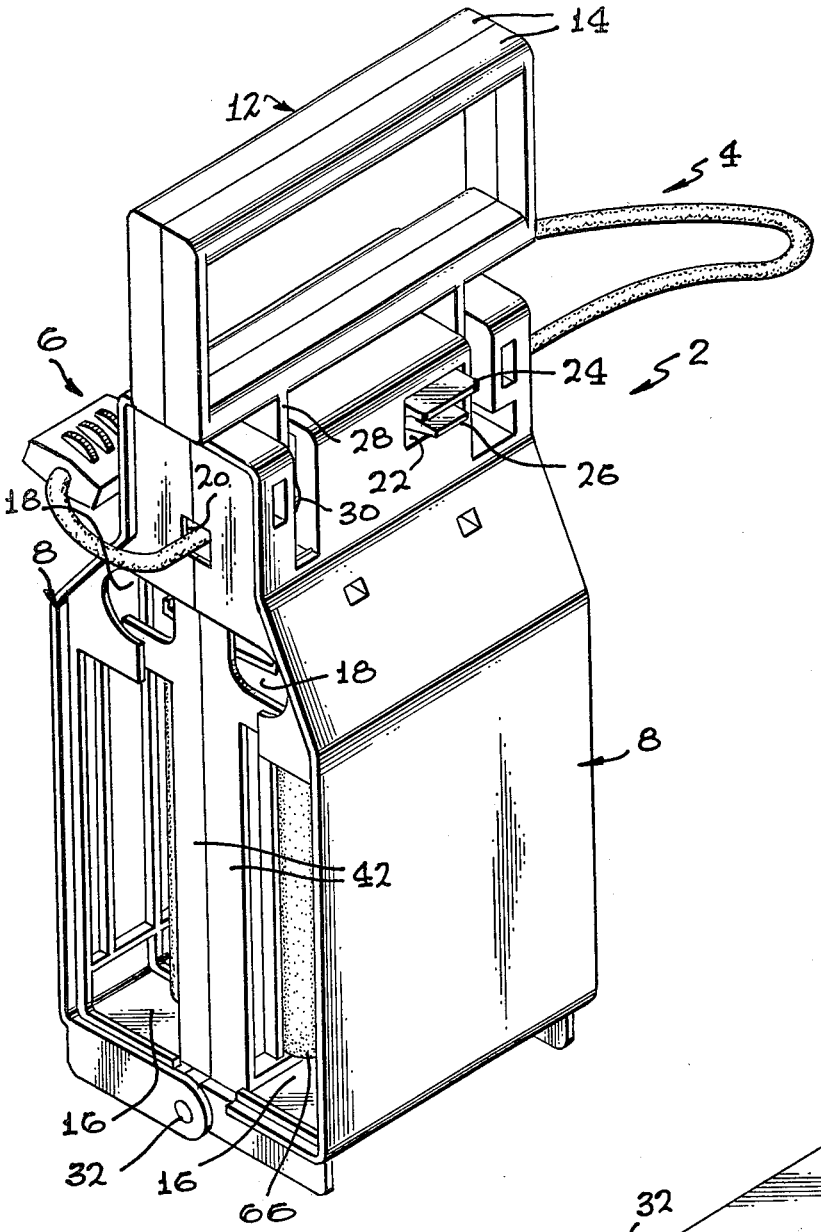
FIG. 1
FIG. 2
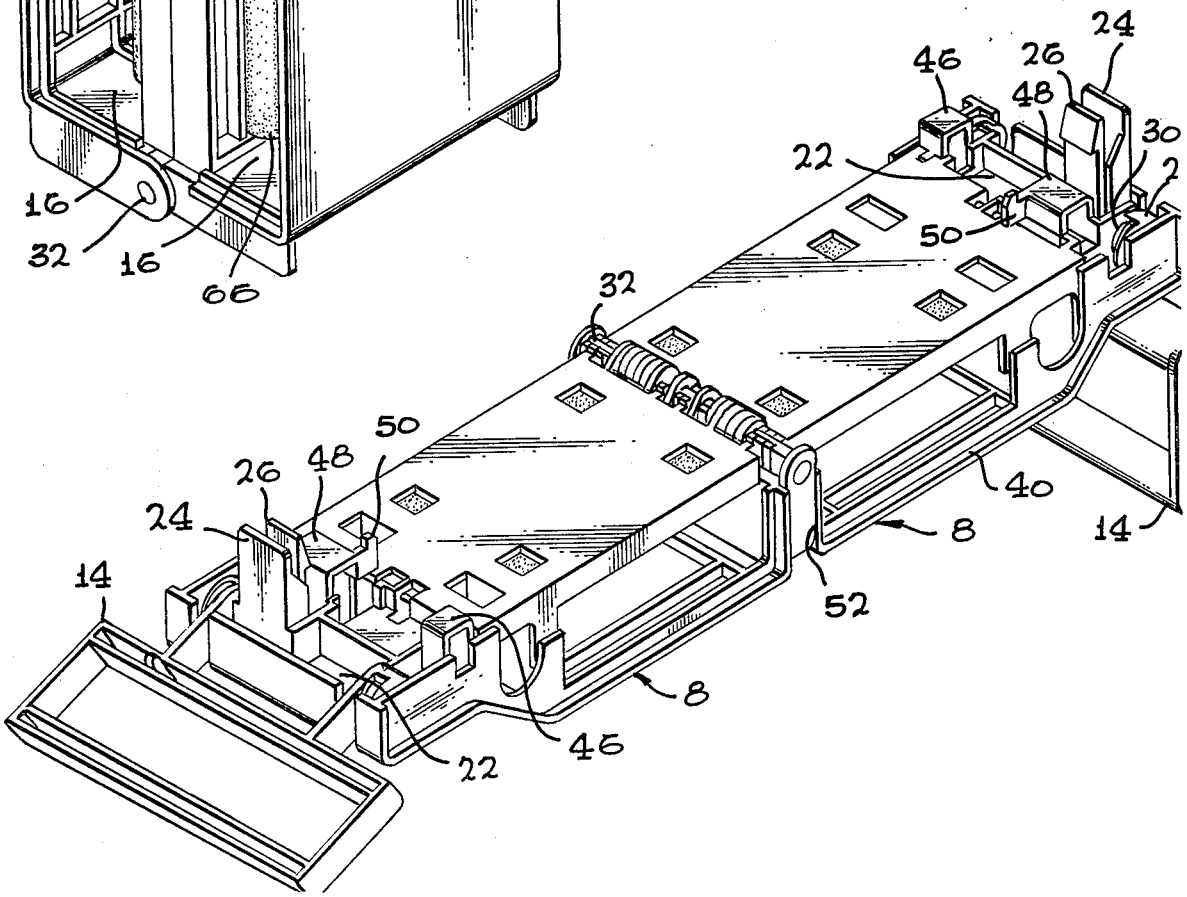

DEVICE FOR CARRYING ELONGATED ITEMS

BACKGROUND OF THE INVENTION

1. Field of the Invention

The present invention relates to the field of carrying items, and more particularly to a device for conveniently and securely carrying elongated items which are otherwise awkward or difficult to transport. The invention is particularly useful for skiers as a device for conveniently and securely carrying a pair of skis and ski poles.

2. Description of the Prior Art

Certain items are difficult to carry and manipulate due to their particular size, shape, or weight characteristics. For example, elongated items cause difficulty in transporting from one location to another and/or are difficult to store conveniently, and in the sporting field these might include such things as skis and ski poles, bows and arrows, rifles, helicopter blades, fishing gear, and surfing or sailing paraphernalia.

An example of a device for carrying skis and ski poles can be found by reference to U.S. Pat. No. Des. 245,041, issued July 12, 1977, to Calvin J. Covell, and the associated U.S. Pat. No. 3,990,655 issued Nov. 9, 1976 to the same inventor. The Covell device includes a support member having a cross section configuration in the shape of an inverted "T" with a handle at the top end of the support member and the cross of the inverted "T" defining a rectangular base member, the support member, including the handle and rectangular base member being of integral and unitary construction. A pair of rectangular wing members are hinged to opposite sides of the rectangular base member, the free ends of the wings being pivotally movable to lie adjacent the top of the support member below the handle and secured in place to define a closed position for the carrying device. Means are provided for locking the wings in the closed position. The wings have compression pads disposed on their inner surfaces to bear against a pair of skis, one ski being held within the carrying device on either side of the support member by the corresponding wing of the device. Notches on the inner surface of each wing are provided for bearing against the shaft of a ski pole, with one ski pole secured by each of the pair of wings on opposite sides of the support member.

While the Covell device operates satisfactorily to organize the skis and ski poles into a relatively secure arrangement, the prior art device has several shortcomings. Specifically, the Covell device is difficult to secure into a position in which compressive forces are applied against the skis. Covell proposes to use a plastic tab with several holes therein passed through the device in the closed position and the device is held in the closed position by an insert passed through one of the holes. Thus the user would, of necessity, be required to apply compression forces to the wings of the device with one hand while the other hand is used for inserting a retaining pin or cable into one of the holes in the tab. Thus, fastening the device in the closed position is inconvenient, awkward, and time-consuming; and if the retaining insert is lost, the device is inoperative.

Moreover, the Covell device secures skis only in the closed position which would preclude the use of the device in a horizontally disposed ski rack on the top of a vehicle. Accordingly, the user would necessarily remove the skis from the device and place them in the horizontal ski rack of the vehicle in normal fashion, and at the skiing location would be required to remove the skis from the vehicle rack and reinsert them into the ski carrying device. Again, this is an extremely inconvenient procedure, and there is thus a need in the art for a carrying device which could be readily mounted onto the roof rack of a vehicle without the necessity of removing the skiis from the carrying device.

The Covell device is described as being made from plastic material, and while a cable and lock may be applied to secure the device to a stationary object, such as a tree, because of the simple tab/slot design for securing the wings against the support member, a moderate pressure applied with a pocketknife could easily sever the projecting end of the tab, thereby offering little discouragement to a potential thief. Accordingly, there is a need for providing a more secure locking arrangement for such a carrying device, even if the device is constructed of plastic material.

The Covell device also suffers in the marginal securement of the skiis and poles even in the closed position thereof. The poles, for example, are held by a v-shaped notch which would make the operating of the device clumsy and the positioning of the poles in rather loose association with the device until the corresponding wing has been brought to its completely closed position.

It can therefore be appreciated that there is a need in the art for an improved ski carrying device which will retain the skiis and poles in a more secure condition, would be simple to operate, would be more secure, and would offer the ability to transport the skiis in either a horizontal or vertical rack mount on the top of a vehicle. The present invention satisfies this need.

BRIEF DESCRIPTION OF THE INVENTION

Although the construction and function of the device according to the present invention is suitable for carrying elongated items of any type, for the sake of convenience in describing the invention, the following description will exemplify the device as being for conveniently and securely carrying skiis and ski poles. It is to be understood, however, that the advantages over the prior art suggested above are equally applicable to the carrying of other elongated items, especially of the type enumerated earlier in this description.

Basically, the device comprises a pair of hingeable members each having means for securing one or more of the elongated items. Hinge means are provided for hingeably connecting the hinge ends of each hingeable member. A handle means is coupled to at least one of the members at a handle end opposite the hinge end thereof. Finally, latch means on the two members cooperate to releasably latch the members together in side-by-side relationship to define a closed position for the device.

In a preferred embodiment, each of the hingeable members comprises an inner plate member and an outer plate member, each inner plate member being hinged at the hinge means and releasably secured to the outer plate member, a cavity being provided between the inner and outer plate members for receiving the elongated items. A securing means is provided for releasably securing the inner and outer plate members together in side-by-side relationship with the inner plate member positioned between the associated outer plate member and the other inner plate member.

A snap latch automatically secures the inner plate member with the outer plate member of each hingeable member when the inner and outer members are brought together. Additionally, a manually movable capture latch is provided, preferably associated with the movement of the handle in a pivotal motion, the movable capture latch having a first position in which the inner and outer plate members are releasable from one another, and a second position in which the inner and outer plate members are fastened in a side-by-side relationship, whereby releasing the snap latch is effective to permit separation of the inner and outer plate members when the movable latch means is in its first position, and ineffective to do so when the movable latch is in its second position.

Preferably, the latch means for each hingeable member is located on the respective inner plate member, whereby bringing both the inner plate members together in face-to-face relationship is effective to latch the inner plate members together in a locked position independent of the position of each outer plate member relative to its corresponding inner plate member.

In order to automatically prevent latching operation of the snap latch when the inner and outer plate members of each hingeable member are brought together in a closed relationship, a cam element on each inner plate member is accessible from the inner face of the opposite inner plate member when the two inner plate members are latched together by the latch means. The cam element is positioned, relative to the snap latch on the non-adjacent one of the outer plate members so that when the two inner plate members are latched together, the cam elements cam the snap latch elements out of the latched condition.

Both skiis and ski poles are accommodated in the cavity defined between the inner and outer plate members of each hingeable member, and a flexure is provided on one of the inner and outer plate members and has a lip projecting into the cavity portion receiving the ski poles to yieldably apply pressure against the ski poles even during hinging motion of the plate members in the non-closed position. For securing the hingeable members of the device with a cable and lock combination, each of the hingeable members is provided with an enclosed passageway portion which, when the members are all hinged together in a closed position for the device, defines a composite aligned passageway through the device parallel to the axis of the hinge means, whereby a security strap may be passed through the composite passageway to prevent moving the members apart out of the closed position, independent of the condition of any latch means.

When in the closed position of the device, the user may operate the manually movable latch to open the device automatically for insertion of the poles and skiis in their respective cavities. Alternatively, from the closed position of the device, the user may release the latch means locking the hingeable members together, from a position external to the outer surfaces of the hingeable members, whereby the inner and outer plate members of each hingeable member remain locked together, while each pair of locked-together plate members, defining the hingeable members, are released for pivotal motion about the hinge means to assume the aforementioned horizontal configuration for the device.

In an alternative configuration, the invention comprises first, second, and third hingeable members, each having opposite ends defining a hinge end and a handle end. A hinge means connects the hinge ends of each of the three members together, the second member being sandwiched between the first and third members in a closed position of the device. One of the elongated items is releasably secured between the first and second members, while a second one of the items is secured between the second and third members. A handle means is coupled to at least one of the first, second, and third members at their respective handle ends, and means are provided to releasably secure all three members together to define the aforementioned closed position. The first and second members may be secured together independently of the securing together of the third and second members. Preferably, the handle includes a separate pivotable handle part on each of the first and third hingeable members, the two handle parts forming a complete handle when the handle parts are pivoted toward one another in the closed position of the device. In order for the device to be able to releasably secure the elongated items and to releasably open to the horizontal position, the second hingeable member comprises first and second plate members which are releasably locked together, and hingedly separate to permit opening of the device into the horizontal position with the two plate members of the second hingeable member being lockable with the corresponding first and third hingeable members while retaining one of the elongated items between the first and second plate members and the corresponding first and third hingeable members.

BRIEF DESCRIPTION OF THE DRAWINGS

The invention will now be described in detail having reference to the accompanying drawings in which:

FIG. 1 is a perspective view of the carrying device according to the present invention, with the device shown in the closed position;

FIG. 2 shows the carrying device in the fully open or horizontal position;

DETAILED DESCRIPTION OF THE PREFERRED EMBODIMENTS

FIG. 1 shows the elongated item carrying device 2 in a closed position. A security strap 4 may be passed through a passageway 20 to secure the device in the closed position independent of the operation of any latch means locking the separate pieces of the device together, to be discussed in detail later in this description. A lock 6 for the security strap 4 may be provided so as to allow the user to lock the device to any secure object, such as a tree. The security strap 4 may be of a length suitable to function as a shoulder strap for freeing the hands of the user while carrying it.

Figure 4:
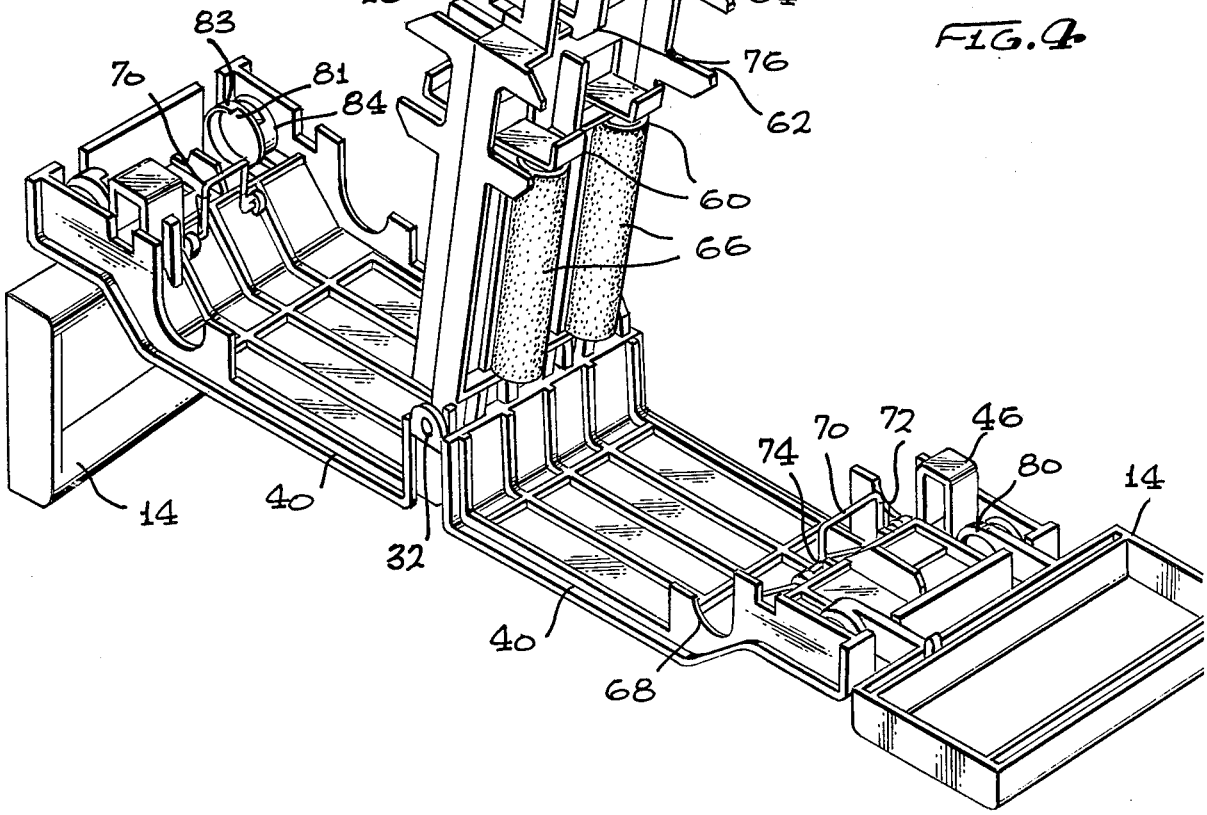
FIG. 4 shows the ski-insertion position of the device with the middle section thereof freely hingeable relative to the outer two hingeable members.

The device opens from the closed position into two possible configurations. FIG. 2 shows the fully open, or horizontal, position which permits the device to be mounted on a horizontal ski rack on the roof of a vehicle while maintaining securement of the skiis and poles within the two halves of the device. The second possible open position for the device, starting from the closed position, is shown in FIG. 4. This is the ski-insertion position for the device.

Returning to FIG. 1, a pair of outer plates 8 are hinged at hinge 32 and are brought together in side-by-side relationship when the device is in the closed position. A handle 12 is located at the upper end of the device as viewed in FIG. 1, the handle 12 being separable into two handle parts 14, best seen in FIG. 2.

In the closed position of the device, as seen in FIG. 1, a pair of cavities 16 are formed within which the skiis are securely held. A separate set of smaller cavities 18 accommodate the ski poles in secure position.

In the horizontal position of FIG. 2, the device functions to securely hold the skiis and poles between inner plate members 42 and outer plate members 40 with each set of inner and outer plates being secured together and hingeable relative to one another about hinge 32. The "L" configuration of the base of each outer plate 40 provides an automatic stop means 52 for limiting the angular movement of the two halves of the device away from each other to approximately 180 degrees.

The two inner plates 42 may be latched together by a hook latch 26 which, together with a finger support 24, project through an access opening 22 in the outer plates 40 of the device. By squeezing the projecting end of the hook means 26 and the finger support 24 toward one another, the hook latch is released from the opposite inner plate 42, and this releasing of the hook latch 26 may be accomplished without pivoting the handle parts 14, the operation of which is described infra. Separate latch means, to be described later, maintain each half of the device shown in FIG. 2 in a securely latched position so that the fully open, horizontal, condition of the device permits mounting the device on the roof rack of a vehicle without rearranging the skiis or poles.

Figure 3:
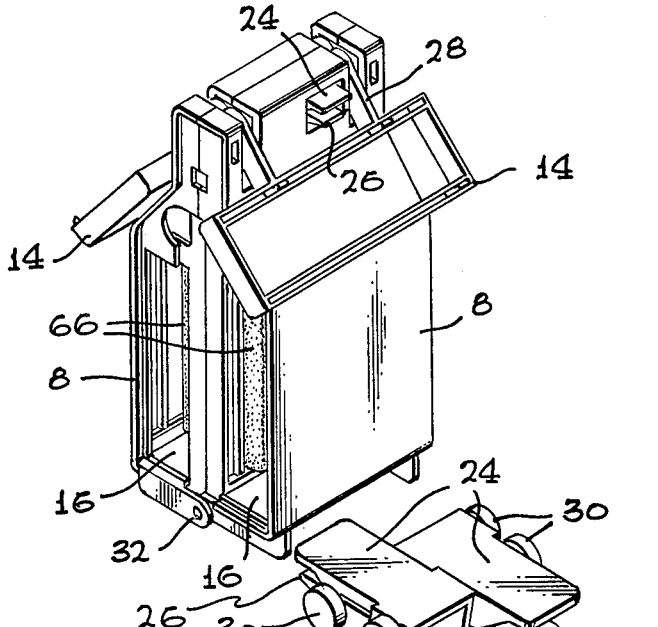
FIG. 3 shows the release position for the operating handle of the device for opening the device to a ski-insertion position.

In the drawing of FIG. 3, it can be seen that the handle 12 is comprised of two handle halves or handle parts 14. Each handle part 14 is pivotable to the lowered position shown in FIG. 3, and as will be described in detail later, the movement of handle parts 14 into the position shown in FIG. 3 is operative to release the separate hingeable members of the device to attain a ski-insertion position as shown in FIG. 4.

In the ski-insertion position, the middle section, comprised of the two inner plates 42 latched together by hook latch 26, is free to pivot about hinge 32 in either direction toward the horizontally disposed outer plates 40. As can be observed, the middle section and outer plates 40 all pivot about hinge 32.

In use, the middle section, comprising inner plates 42, can be rotated downwardly in FIG. 4 to rest against the left outer plate 40. A ski is then positioned above pressure pads 66, and a ski pole is inserted into the C-shaped jaws 62, the poles being retained in jaws 62 by the retaining pressure of flexures 60 which have upwardly projecting outer lips 61 (FIG. 5) that give way during insertion of the ski poles into the jaws and apply a retaining bias against the pole as the flexures 60 tend to return to their normal position. As a result, the poles are at least partially retained in their secured position during manipulation of the device, even if the middle section is to be moved up or down before the ski and pole can be tightly secured by being sandwiched between the middle section, i.e. the appropriate inner plate 42, and the associated outer plate 40.

Each inner plate 42 is latchable to its corresponding outer plate 40 by a pair of independently operated latch means, a snap latch comprising a wire loop 70 and extension finger 76, and a manually movable capture latch comprised of capture socket 80 and projecting boss 30. The operation of these two latch means will be described in connection with the drawings of FIGS. 4–6.

When the two inner plates 42 are latched together by hook latch 26, as seen in FIG. 4, a cam element 50 projects from each inner plate 42 through an opening 90 in the opposite plate 42 so as to be accessible from the outer face of the opposite plate 42. A wire loop 70 is biased toward the handle end of the device by a spring 72, the wire loop 70 being limited in its biased direction by a stop 74. When the latched pair of inner plates 42 are brought into side-by-side relationship to either outer plate 40, the cam element 50 cams the wire loop away from the end of the projecting finger 76 against the bias of spring 72 so as to prohibit latching of the snap latch. As a result, the inadvertent or premature closing of the middle section with either outer plate will not allow latching therewith. On the contrary, the inner plates are to be maintained in a latched condition with their corresponding outer plates by the snap latch 70,76 only when the device is in the, horizontal, fully open position of FIG. 2. This condition is satisfied automatically, since the cam element 50 of each inner plate 42 does not project through the opposite plate 42 when the two inner plates 42 are separated. As a result, upon separating the inner plates 42, one from the other, the rotation of each inner plate 42 towards its outer plate 40 will; when fully closed, cause an automatic latching of wire loop 70 with the projecting end of finger 76. This assumes that the manually movable capture latch 80,30 is in a position to accommodate such action, as will be described in the following.

Figure 5:
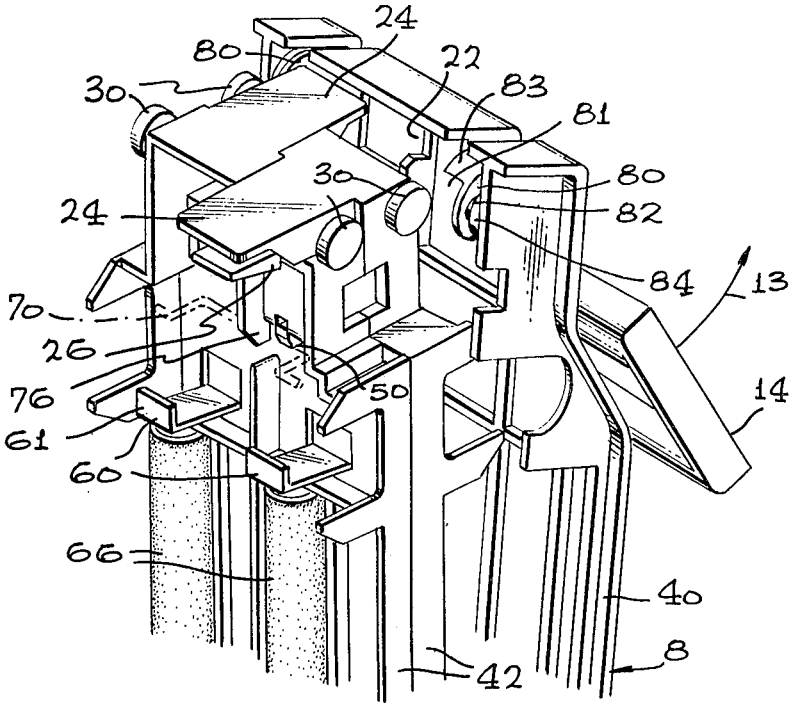
FIG. 5 shows a detailed illustration of the middle section of the device, wherein the two parts making up the middle section are latched together, while the arrangement for securing the middle section to one of the outside hingeable members is shown in the position just prior to securement.

As best seen in FIG. 5, the downward pivoting of handle part 14 about shaft 82, rotatable in bearing 84, causes rotation of capture socket 80 to position a slotted segment 81 of socket 80 in the path of the cooperating projecting boss 30 affixed to the upper end of the corresponding inner plate 42. As the inner plate 42 is brought into closed position relative to its corresponding outer plate 40, the projecting boss 30 aligns coaxially with capture socket 80 and shaft 82. Handle part 14, shown in the unlocked position in FIG. 5, is attached to capture socket 80 by handle stems 28, such that, upon movement of handle part 14 in the direction of arrow 13, capture socket 80 is rotated about boss 30 to present a barrier 83 to the inner side of the projecting boss 30, thereby preventing the associated inner plate 42 from being pivotally movable away from its corresponding outer plate 40. Thus, it can be appreciated that, when the two inner plates 42 are latched together so that the snap latch 70,76 is ineffective, the user has full control over the latching or unlatching of the inner and outer plates by the manual manipulation of the capture latch 80,30. Additionally, since the capture latch is operable by movement of handle parts 14, the inner and outer plates of either half of the device can be readily latched and unlatched at the whim of the user by simple rotation of the corresponding handle part 14. In this connection, the ski-insertion position of FIG. 4 shows the handles in the locked position without having the boss 30 captured in the corresponding socket 80. However, since one of the operational modes of the carrying device is to place a ski and pole on top of the middle section and then to bring the corresponding outer plate 40 to a closed position to secure the ski and pole in place, the user can conveniently grasp the handle part 14, rotate the outer plate 40 over the inserted ski and pole, and in the motion for carrying out this function, the handle part 14 is automatically rotated to the unlocked position by the time the outer plate has reached the corresponding inner plate. The user merely applies a downward pressure to the outer plate 40 or handle, whichever is more convenient, applies a slight rotational motion to the handle part 14 toward the locked position to initially secure the boss 30 against barrier 83, and then, upon pivoting the middle section and outer plate, being locked together, in the opposite direction, causes a complete closure of the capture latch 80,30 when the middle section and latched outer plate 40 have been rotated to the opposite horizontal position. This leaves the other, non-manipulated, outer plate 40 free to be rotated toward the middle section after insertion of the other ski and pole thereon, and a similar capture latch function may be performed.

Figure 6:
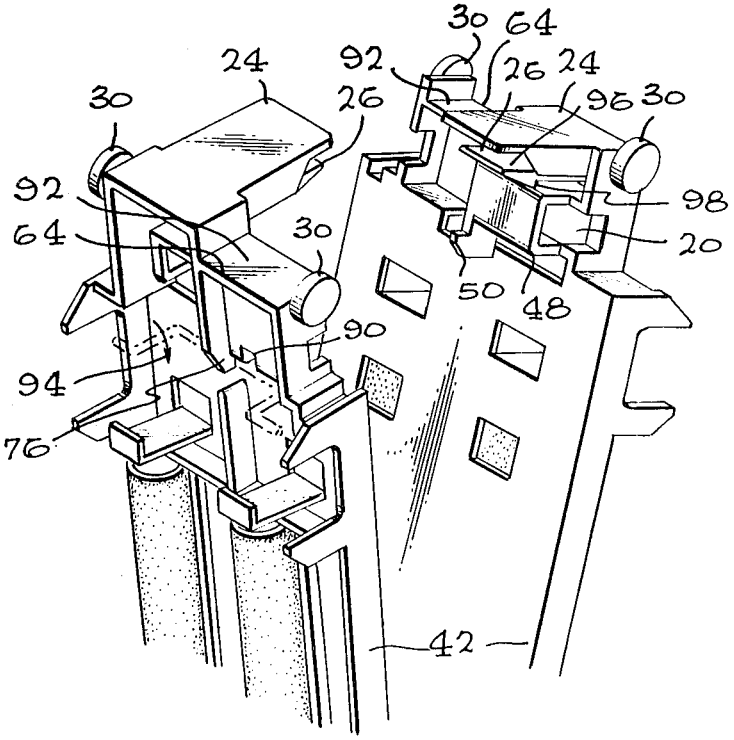
FIG. 6 is a detailed illustration of the middle section of the device slightly separated to show the manner in which the middle section parts may be locked together.

FIG. 6 shows the inner plates 42 slightly displaced angularly from one another to illustrate the manner in which the hook latch 26 operates. As the two plates 42 are brought together, the hook latch 26 under each finger support 24 has its wedge-shaped projecting end portion 96 resiliently cammed over the flat bearing surface 92 until the hook portion 98 of hook latch 26 is locked into position against hook retaining edge 64 of bearing surface 92. The two plates 42 may be separated only by operating both hook latches 26 by squeezing the projecting end 96 of each hook latch 26 against its cooperating finger support 24. The ends of finger support 24 and latch hook 26 are accessible through access opening 22 in each outer plate 40. When the two inner plates 42 are brought together, the cam element 50 projects through opening 90 in the opposite inner plate to cam the wire loop 70 in the direction of arrow 94.

With reference to FIGS. 2, 4, and 6, the passageways 48 on inner plates 42 and the passageways 46 on outer plates 40 comprise segments of a composite passageway 20 when all of the inner and outer plates are brought to the closed position for the device. In this way, a potential thief would be discouraged from tampering with the device when attached to a security strap.

From the above description, a device has been described for carrying elongated items securely and conveniently. The device is openable from a closed position to attain two configurations, a fully open, horizontal, position and a ski-insertion position. In a preferred embodiment, the device comprises four hingeable plate members, two inner plate members, and two outer plate members. In the horizontal position, the device lies flat with a pair of inner and outer plates latched together by a hook latch and lying at an angle of 180 degrees with respect to the other pair of inner and outer plates. In this position, merely bringing the two halves of the device together latches the two inner plate members together by the hook latch means, and the device attains its closed position. From the closed position, the two handle parts may be rotated downwardly which releases the manually movable capture latch 80,30, permitting the middle section comprised of the latched-together inner plates 42 to be freely rotatable toward either of outer plates 40 which, in turn, are free to rotate about the hinge for the device between zero and 180 degrees with respect to the other outer plate member. When in the ski-insertion position, the middle section is prevented from latching with either outer plate due to a camming of the wire loop 70 away from its projecting latching finger 76. Accordingly, the middle section may only be latched to the outer plates by means of a manually movable capture latch 80,30. In the horizontal position, the skis, while secured in the device, are carried by the rack mount of a vehicle, using normal procedures, and at the resort site, the skier may merely release the skis from the vehicle ski rack, and when the handle parts 14 are brought together, hook latch 26 engages, and the device is ready for transporting the skis and poles without further manipulation. When the skier is ready to don the skis, he or she merely separates the handle parts 42 and gently pushes them downwardly. This simple motion releases the capture latch 80,30, and since the snap latch 70,76 is already unlatched, each outer plate 40 is readily movable about hinge 32 to release its captured ski and ski pole. Although the ski pole is partially retained in jaws 62 by the lips 61 of flexures 60, the pressure is slight, and the poles can be easily removed without difficulty after the outer plate 40 has been swung to an open position.

The invention, as described and shown, is uniquely adapted to be constructed with a minimum amount of tooling due to the ability of the device to accommodate identical halves, i.e. the left and right halves may be identically molded and assembled. Laterally offset hinge attachment ears are provided on each of the hingeable members to allow a symmetrical configuration of all of the opposing like members.

While the invention has been particularly shown and described with reference to the preferred embodiment and alterations thereto, it should be understood by those skilled in the art that various changes in form and detail may be made therein without departing from the spirit and scope of the invention. Accordingly, the invention is to be limited only by the appended claims.

I claim:

1. A device for conveniently and securely carrying elongated items, comprising:

a first hingeable member having an inner plate means and an outer plate means, said inner and outer plate means defining a first cavity for receiving a first one of said items;

a second hingeable member having means for releasably securing a second one of said items;

hinge means for hingedly connecting a hinged end of said inner and outer plate means of the first member to a hinged end of said second member;

handle means coupled to at least one of said first and second members at a handle end opposite said hinged end thereof;

latch means on said first and second members cooperating to releasably latch said first and second members together in a side-by-side relationship to define a closed position of said device; and a first securing means for releasably securing said inner and outer plate means together in side-by-side relationship with said inner plate means positioned between said outer plate means and said second member.

2. The device as claimed in claim 1, wherein:

said second member comprises a second inner plate means and a second outer plate means, said second inner plate means hinged at said hinge means and releasably secured to said second outer plate means, said second inner and outer plate means including means defining a second cavity for receiving said second elongated item; and a second securing means for releasably securing said second inner and outer plate means together in side-by-side relationship with said second inner plate means positioned between said second outer plate means and said first member.

3. The device as claimed in claim 2, wherein:

said latch means comprises a hook means on one of said members and a cooperating hook retaining means on the other of said members;

one of said hook means and hook retaining means is yieldable laterally of said hook means to cause a biased sliding effect prior to a latching action between said hook means and said retaining means;

said first and second members are substantially identically conformed and constructed; and each of said first and second members has one of said hook means and one of said cooperating hook retaining means thereon; and the release of both of said hook means and hook retaining means is required in order to release said first and second members from said closed position.

4. The device as claimed in claim 2, wherein:

said latch means and said first and second securing means all operate independently of one another, such that said inner and outer plate means of each member can remain secured during hinging motion of said first and second members with respect to each other.

5. The device as claimed in claim 2, wherein:

said inner and outer plate means of each of said first and second members all pivot about a common axis.

6. The device as claimed in claim 2, wherein said first and second securing means each comprises:

a snap latch means on said inner and outer plate means of each said hingeable member for automatically securing each inner plate means to its associated outer plate means when said inner and outer members are brought together; and a manually moveable latch means having a first position in which said inner and outer plate means are releasable, and a second position in which said inner and outer plate means are fastened in a side-by-side relationship;

whereby releasing said snap latch means is effective to permit separation of said inner and outer plate means when said moveable latch means is in said first position, and ineffective to do so when said moveable latch means is in said second position.

7. The device as claimed in claim 6, wherein said moveable latch means comprises:

a projecting boss on one of said inner and outer plate means; and a capture socket on the other plate means, said capture socket being rotatable and having a slot for clear passage of said boss in and out of said socket when said manually moveable latch means is in said first position, and having a barrier in the path of said boss when said manually moveable latch means is in said second position.

8. The device as claimed in claim 7, wherein:

said capture socket is attached to said handle means; and said device includes means for rotating said handle means to effect movement of said capture socket from a first to a second position corresponding to said first and second positions, respectively, of said manually moveable latch means.

9. The device as claimed in claim 6, wherein:

said latch means for each of said hingeable members is located on the respective one of said inner plate means, whereby bringing both said inner plate means together in face-to-face relationship is effective to latch both said inner plate means together in a locked position independent of the position of each outer plate means relative to its corresponding inner plate means.

10. The device as claimed in claim 9, wherein:

each of said inner plate means includes a cam element accessible from the inner face of the opposite inner plate means when said two inner plate means are latched together by said latch means; and said cam element is positioned, relative to said snap latch means on the non-adjacent one of said outer plate means, to automatically prevent latching operation of said snap latch means when said two inner plate means are latched together and said inner and outer plate means of each hingeable member are brought together in a closed relationship.

11. The device as claimed in claim 2, wherein:

said inner and outer plate means of said first hingeable member includes means defining a third cavity for receiving a third elongated item; and said inner and outer plate means of said second hingeable member includes means defining a fourth cavity for receiving a fourth elongated item.

12. The device as claimed in claim 11, including:

a flexure on one of said inner and outer plate means of each hingeable member, said flexure having a lip projecting into said third and fourth cavities, respectively, whereby yieldable retaining pressure is applied against said third and fourth respective elongated items for retaining said third and fourth items in a fixed position in said third and fourth cavities even when said inner and outer plate means are angularly separated from one another.

13. The device as claimed in claim 2, wherein:

each of said inner and outer plate means has closed wall means defining a passageway parallel to the axis of said hinge means, each said passageway being positioned to define an aligned composite passageway through said device when said device is in said closed position;

whereby a security strap may be passed through said aligned passageway to prevent moving any of said plate means away from its adjacent plate means independent of the condition of said latch means and said securing means.

14. The device as claimed in claim 1, wherein:

said latch means comprises a hook means on one of said members and a cooperating hook retaining means on the other of said members; and one of said hook means and hook retaining means is yieldable laterally of said hook means to cause a biased sliding effect prior to a latching action between said hook means and said retaining means.

15. The device as claimed in claim 14, wherein:

said first and second members are substantially identically conformed and constructed; and each of said first and second members has one of said hook means and one of said cooperating hook retaining means thereon;

whereby release of both said hook means and retaining means is required in order to release said first and second members from said closed position.

16. The device as claimed in claim 15, wherein:

each of said hingeable members has an access opening therethrough for receiving said hook means from the other hingeable member; and each said hook means has an operating tab projecting forwardly of a hook portion thereof and beyond the outer surface of said other hingeable member.

17. The device as claimed in claim 1, wherein each hingeable member has stop means for limiting the extent of rotation of said member about said hinge means to a predetermined angle.

18. The device as claimed in claim 17, wherein the stop means limits the extent of rotation of said member about said hinge means to an angle of 180°.

19. The device as claimed in claim 1, wherein said first and second hingeable members have closed wall means defining an aligned passageway through said device parallel to the axis of said hinge means;

whereby a security strap may be passed through said passageway to prevent moving said members apart out of said closed position independent of the condition of said latch means.

20. A device for conveniently and securely carrying elongated items, comprising:

first, second, and third hingeable members, each having opposite ends defining a hinge end and a handle end;

hinge means for hingedly connecting the hinge ends of said first, second, and third members at their respective hinge ends, said second member being sandwiched between said first and third members in a closed position of said device;

means for releasably securing a first one of said items between said first and second members;

means for releasably securing a second one of said items between said second and third members;

handle means coupled to at least one of said first, second, and third members at their respective handle ends; and securing means for releasably securing said first, second, and third members together to define said closed position of said device.

21. The device as claimed in claim 20, wherein said securing means comprises:

a first securing device for securing said first and second members together; and an independently operable second securing device for securing said third and second members together.

22. The device as claimed in claim 21, wherein: said handle means comprises a pivotable handle part and an associated pivot means on each of said first and third hingeable members;

said handle parts form a complete handle when said handle parts are pivoted toward one another in the closed position of said device;

each said first and second securing device includes means manually operable between a secured position in which said first and second and said third and second members, respectively, are locked together, and a released position in which all three members can hinge freely of the other members; and each said securing device is operated by pivoting the respective handle part away from the other handle part at an angle greater than a predetermined angle.

23. The device as claimed in claim 21, wherein:

said second hingeable member comprises first and second plate means;

said first plate means is securable with said first member by its associated securing device and defines a first cavity therebetween;

said second plate means is securable with said third member by its associated securing device and defines a second cavity therebetween; and each said first and second plate means includes a latch means for releasably latching said first and second plate means together.

24. The device as claimed in claim 23, including a snap latch means on the associated plate means and hingeable member pair for automatically securing each plate means to its associated hingeable member when said associated plate means and hingeable member are brought together; and wherein said first and second securing devices each comprises:

a manually moveable latch means having a first position in which said plate means and associated hingeable member are releasable, and a second position in which said plate means and associated hingeable member are fastened in a side-by-side relationship;

whereby releasing said snap latch means is effective to permit separation of said plate means and associated hingeable member when said moveable latch means is in said first position, and ineffective to do so when said manually moveable latch means is in said second position.

25. The device as claimed in claim 24, wherein:

said manually moveable latch means comprises a projecting boss on one of said plate means and associated hingeable member, and a capture socket on the other of said plate means and associated hingeable member, said capture socket being rotatable and having a slot for clear passage of said boss in and out of said socket when said manually moveable latch means is in said first position, and having a barrier in the path of said boss when said manually moveable latch means is in said second position;

said capture socket is attached to a corresponding handle part; and said device includes means for rotating said handle part to effect movement of said capture socket from a first to a second position corresponding to said first and second positions of said manually moveable latch means.

26. The device as claimed in claim 24 wherein:

said latch means for releasably latching said first and second plate means together is effective to keep said first and second plate means locked together independently of the position of said first and third hingeable members.

27. The device as claimed in claim 26, wherein:

each of said first and second plate means includes a cam element accessible from the inner face of the opposite plate means when said two plate means are latched together by said latch means, said cam element being positioned, relative to said snap latch means on the non-adajacent one of said hingeable plate means, to automatically prevent latching operation of said latch means when said plate means and associated hingeable member are brought together in a closed relationship.

* * * * *